US006733353B2

(12) United States Patent
Murtishaw et al.

(10) Patent No.: US 6,733,353 B2
(45) Date of Patent: May 11, 2004

(54) METHOD AND SYSTEM FOR HEATING CATHODE RAY TUBES DURING FRIT KNOCKING TO PREVENT ELECTRICAL ARCING

(75) Inventors: David Allen Murtishaw, Sun City, CA (US); Brian Michael Solomich, Vista, CA (US); Edward Martinez, Vista, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 265 days.

(21) Appl. No.: 09/839,250

(22) Filed: Apr. 20, 2001

(65) Prior Publication Data

US 2002/0155777 A1 Oct. 24, 2002

(51) Int. Cl.[7] ..... H01J 9/00

(52) U.S. Cl. ..... 445/5; 445/22; 445/23; 445/24; 445/25; 445/26

(58) Field of Search ..... 445/2, 5, 22, 23, 445/24, 25, 37, 43, 45, 6, 57, 19

(56) References Cited

U.S. PATENT DOCUMENTS 4,682,963 A * 7/1987 Daldry et al.
5,148,737 A * 9/1992 Poulson
5,681,198 A * 10/1997 Peng et al.
5,797,781 A * 8/1998 Yoon
6,296,538 B1 * 10/2001 Chamberlain et al.

* cited by examiner

*Primary Examiner*—Dean A. Reichard
*Assistant Examiner*—Nguyen T. Ha
(74) *Attorney, Agent, or Firm*—Steven L. Nichols; Rader, Fishman & Grauer PLLC

(57) ABSTRACT

Heating or maintaining the temperature of a cathode ray tube that is waiting to undergo frit knocking has been discovered to substantially reduce the dangerous and harmful tendency of electrical arcing between the high-voltage probe and grounded band used in the frit knocking process. Any means or method of heating such a cathode ray tube including, but not limited to, placing the cathode ray tube in an oven or heating unit, or in a heated room or chamber produces beneficial results. Placing the cathode ray tube in an insulated envelope or blanket can also help. In particular, one or more heat packs that are heated in an oven and then brought into thermal contact with the cathode ray tube can be used to heat or maintain the temperature of the cathode ray tube.

31 Claims, 7 Drawing Sheets

METHOD AND SYSTEM FOR HEATING CATHODE RAY TUBES DURING FRIT KNOCKING TO PREVENT ELECTRICAL ARCING

FIELD OF THE INVENTION

The present invention relates to the field of cathode ray tube manufacture, particularly frit knocking. More specifically, the present invention relates to a device and system for heating and maintaining the temperature of a cathode ray tube waiting to undergo a frit knocking process. This is necessary to prevent or minimize arcing during the evaluation of the frit seal in the cathode ray tube using an external high-voltage probe. The present invention provides heated packs that can be applied to the cathode ray tube to increase or maintain its temperature.

BACKGROUND OF THE INVENTION

Cathode ray tubes ("CRTs") are well known in modern society. The CRT is the principal component in such common devices as television sets and computer and video monitors. As shown in FIG. 1, a CRT (100) typically includes a relatively flat display portion (101) (upper portion as seen in FIG. 1). When one is watching television or looking at a computer monitor, that person is looking at the flat display portion (101) of a cathode ray tube. Below the display portion (101) is a funnel portion (102) that narrows into the "neck" of the CRT.

During manufacture, an electro-luminescent material such as phosphorus is coated over the display portion (101) of the CRT. The display portion (101) is then joined to the funnel (102) using a glass paste compound known as frit. A bead of frit is distributed around the interface between the funnel (102) and the display portion (101). The frit is the cured or hardened to form an airtight seal between the display portion (101) and the funnel (102). This seal may be referred to as a frit seal (103).

An electron gun (not shown) is then placed at the end of the CRT's "neck" (102). When the CRT is operated, a yoke (not shown) creates an electromagnetic field and causes the stream of electrons emitted from the electron gun to scan in lines across the surface of the display portion (101). Where the stream of electrons hits the electro-luminescent material, the electro-luminescent material emits light. Thus, by rapidly switching the electron stream on and off, or by varying the power of the electron stream as it sweeps across the display portion of the CRT, an image can be formed in the light emitted by the electro-luminescent material. This is the general principle on which CRTs operate.

After the display portion (101) of the tube is joined to the funnel (102) and the joint between the two is sealed with frit, the completed tube is evacuated. Then, the strength of the frit seal (103) and the integrity of the vacuum are evaluated. This evaluation is known as "frit knocking" and is performed by applying a high-voltage to the anode or funnel portion (102) of the CRT.

In the frit knocking process, a conductive band or strap (104) is wrapped around the frit seal (103) and is in physical and electrical contact with the frit seal (103). The conductive band (104) is grounded (105) as shown in FIG. 1. A high-voltage probe (106) is then positioned to apply a voltage to the anode of the CRT. The probe (106) is connected to a voltage source (109) that provides a high voltage output. The tip (107) of the probe is then brought into contact with a point (108) on the anode or funnel portion (102) of the CRT (100).

If there is any flaw in the frit seal (103), such as an opening, a fracture, a gap, etc., the high-voltage probe (106) will create an electrical arc from within the CRT (100), through the flaw in the frit seal (103) and into the grounded band (104). If such arcing is detected, the failure or lack of integrity in the frit seal (103) is also detected. If such arcing is detected, the CRT (100) must be removed from the production line so that the frit seal (103) can be repaired, patched or replaced. Otherwise, the flaw in the existing frit seal may degrade or even disable the performance of the CRT (100).

While this method provides an adequate means of testing or "knocking" the frit seal in a cathode ray tube, there are also significant problems. Specifically, the distance (d) between the tip (107) of the high-voltage probe (106) and the grounded band (104) is small enough that electrical arcing (130) may occur outside the CRT (100) between the probe tip (107) and the grounded band (104).

This arcing (130) poses many problems. For example, the arcing (130) may be detected and attributed to a flaw in the frit seal (103). If this error is not detected, the CRT (100) will not pass the evaluation even though its frit seal (103) may be in perfect condition. Additionally, even if the error is detected, time may be required to reset the testing apparatus that is erroneously registering a flaw in the frit seal (103). External arcing (130) may also damage the equipment being used to evaluate the frit seal (103).

A critical factor that contributes to this external arcing (130) is the temperature of the cathode ray tube. During normal processing in the CRT production line, the CRTs are maintained at an elevated temperature which minimizes the possibility of external arcing during frit knocking.

However, it sometimes happens production is interrupted or, for some other reason, a tube or tubes must be removed from the production line before frit knocking is performed. When these tubes are ready to be reintroduced to the production line and have their frit seals evaluated, the tubes may have cooled. The cooled tubes are much more likely to experience unwanted external arcing during the frit knocking.

Consequently, there is a need in the art for a method and system of heating or maintaining the temperature of cathode ray tubes that have been temporarily pulled from a production process just prior to frit knocking.

SUMMARY OF THE INVENTION

The present invention meets the above-described needs and others. Specifically, the present invention provides a method and system of heating or maintaining the temperature of cathode ray tubes that have been temporarily pulled from a production process just prior to frit knocking.

Additional advantages and novel features of the invention will be set forth in the description which follows or may be learned by those skilled in the art through reading these materials or practicing the invention. The advantages of the invention may be achieved through the means recited in the attached claims.

The present invention may be embodied and described as a system for heating or maintaining the temperature of a cathode ray tube that is waiting to undergo a frit knocking process. The system preferably includes a heat pack for transferring heat to the cathode ray tube; and an oven for heating the heat pack. A cord is connected to the heat pack by which the heat pack can be suspended on, and in thermal contact with, the cathode ray tube. Preferably, the heat pack is a flexible bag with a heat-retaining and transmitting material disposed in the bag.

Preferably, the oven includes a control system. The control system may include both a thermostat for monitoring the temperature of the oven and a timer for controlling the oven or monitoring the amount of time heat packs have been heated.

The system of the present invention may also include a thermally-insulating envelope sized to receive the cathode ray tube. This envelope may be used to help the cathode ray tube hold its heat, with or without using a heat pack to heat the tube.

The present invention also encompasses the methods of making and using the system described above. However, the method of the present invention is broader than the use of the heat packs described above. The present invention includes a method of preventing external arcing during a frit knocking process in a cathode ray tube production line by heating a cathode ray tube which is waiting to undergo frit knocking. This method may be performed by heating a heat pack; and applying the heated heat pack to the cathode ray tube, such that the heat pack transfers heat to the cathode ray tube.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

Stated in broad principle, the present invention provide a method and system for heating or maintaining the temperature of a cathode ray tube that is waiting to undergo frit knocking. The present invention encompasses any means or method of heating such a cathode ray tube including, but not limited to, placing the cathode ray tube in an oven or heating unit, or in a heated room or chamber. The present invention also encompasses any means or method of maintaining a cathode ray tube at an elevated temperature, including, but not limited to, placing the cathode ray tube in an insulated envelope or blanket.

It has been discovered that heating or maintaining the temperature of a cathode ray tube that is waiting to undergo frit knocking substantially reduces the dangerous and harmful tendency of electrical arcing between the high-voltage probe and grounded band used in the frit knocking process as described above. Consequently, the present invention recognizes and solves this problem in the art.

In a particularly preferred embodiment, which will be described in detail below, the present invention includes one or more heat packs that are heated in an oven and then brought into thermal contact with a cathode ray tube to heat or maintain the temperature of the cathode ray tube.

The present invention will now be described using the appended drawings. The drawings are used to illustrate the preferred embodiments of the present invention and are exemplary only, i.e., the drawings are not intended to limit the scope of the invention to the embodiments illustrated.

Figure 1:
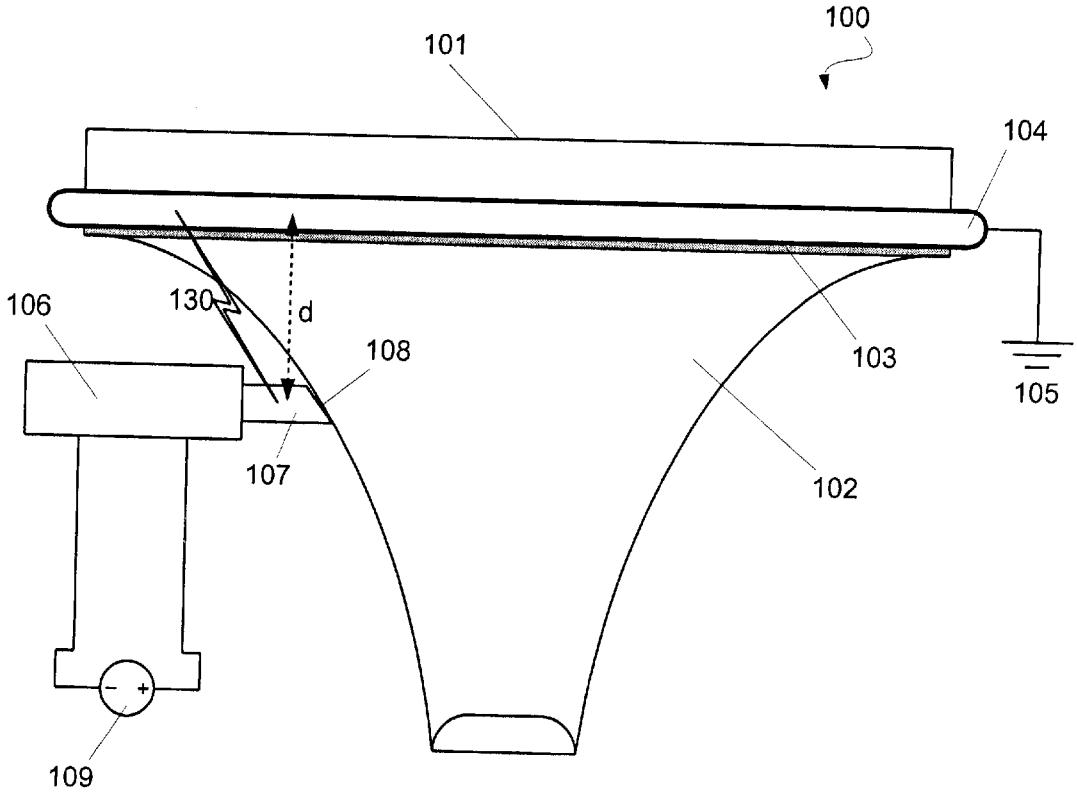
Fig. 1 Prior Art
FIG. 1 is an illustration of a cathode ray tube during a conventional frit knocking procedure in which electrical arcing external to the tube causes problems in the evaluation process.
Figure 2:
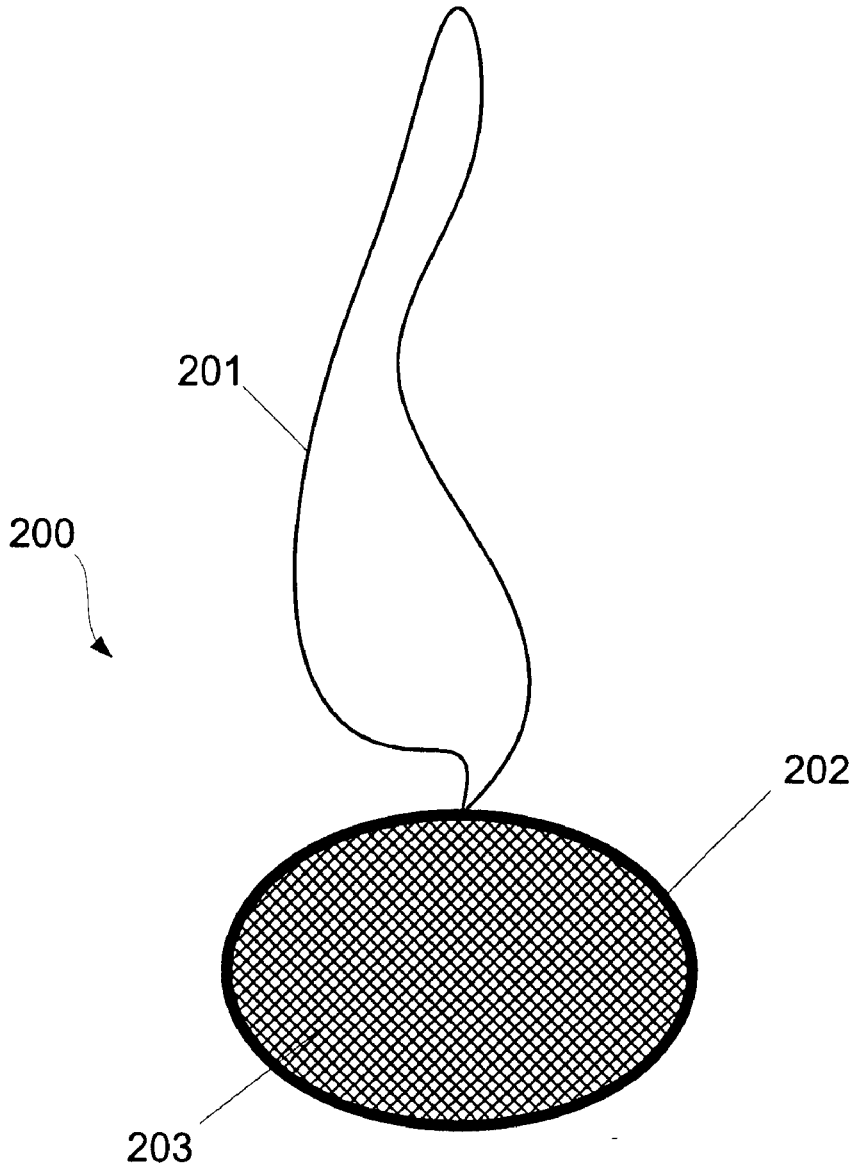
FIG. 2 is an illustration of a heat pack according to the present invention which can be used to heat or maintain the temperature of a cathode ray tube awaiting frit knocking.

FIG. 2 illustrates a preferred embodiment of the heat pack of the present invention. As shown in FIG. 2, the heat pack (200) preferably consists of a flexible skin or bag (202). A heat-conducting material (203) is enclosed in the bag (202). A cord (201) is attached to the bag (202) and is used to dispose the heat pack (200) on a cathode ray tube, as will be described below.

The heat pack of the present invention need not be a flexible bag (202) enclosing a heat-conducting material (203). The heat pack of the present invention may be made of a single material that retains and transmits heat attached to the cord (201). However, the flexible bag (202) embodiment provides certain advantages.

For example, a flexible bag (202) made of rubber or a plastic material, that is filled with a heat-retaining and transmitting liquid, semi-fluid or gel, will naturally deform itself under the influence of gravity to bring more of its surface area into contact with a cathode ray tube which is being heated. Consequently, the heat transfer between the heat pack (200) and the cathode ray tube is enhanced.

The heat-conducting material (203) in the bag (202) can be any material that retains and transmits heat. However, to facilitate deformation of the bag (202) to increase the area in contact with a cathode ray tube being heated, liquid, semi-fluid, gel and particulate materials are preferred. Water, for example, meets the necessary criteria as a heat-conducting material (203) for use in filling the bag (202) of the present invention.

Figure 3:
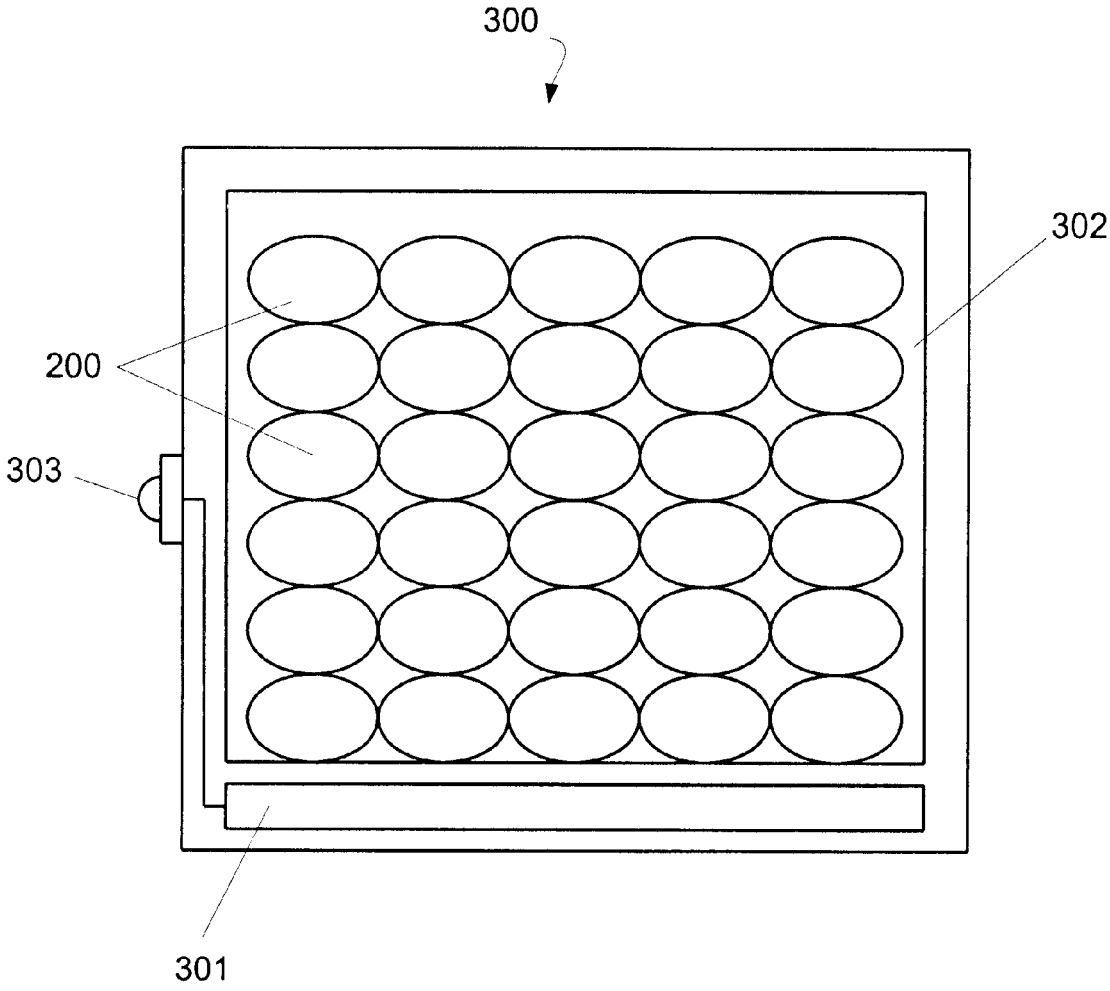
FIG. 3 is an illustration of a heating oven for heating the heat packs illustrated in FIG. 2 according to the present invention.

FIG. 3 illustrates an oven (300) used to heat a supply of the heat packs (200) of the present invention. As shown in FIG. 3, the heat packs (200) are stacked in a heating chamber (302) of the oven (300).

One or more heating elements (301) heat the heating chamber (302). These heating elements (301) may be electric or gas heaters, microwave sources, or any use of any other source of power or heat for the heating chamber (302).

A control system (303) is preferably included to control the heating element(s) (301) of the oven (300). The control system (303) preferably includes a timer and a thermostat. The timer can be used to control a microwave heating element or to regulate how long the heat packs (200) are left in a warn, non-microwave oven. In such a non-microwave oven, the thermostat can regulate the heating elements (301) to maintain the oven (300) and the heat packs (200) at a predetermined temperature which is in the range of temperatures at which the cathode ray tubes can undergo frit knocking without undue risk of external electrical arcing.

Figure 4:
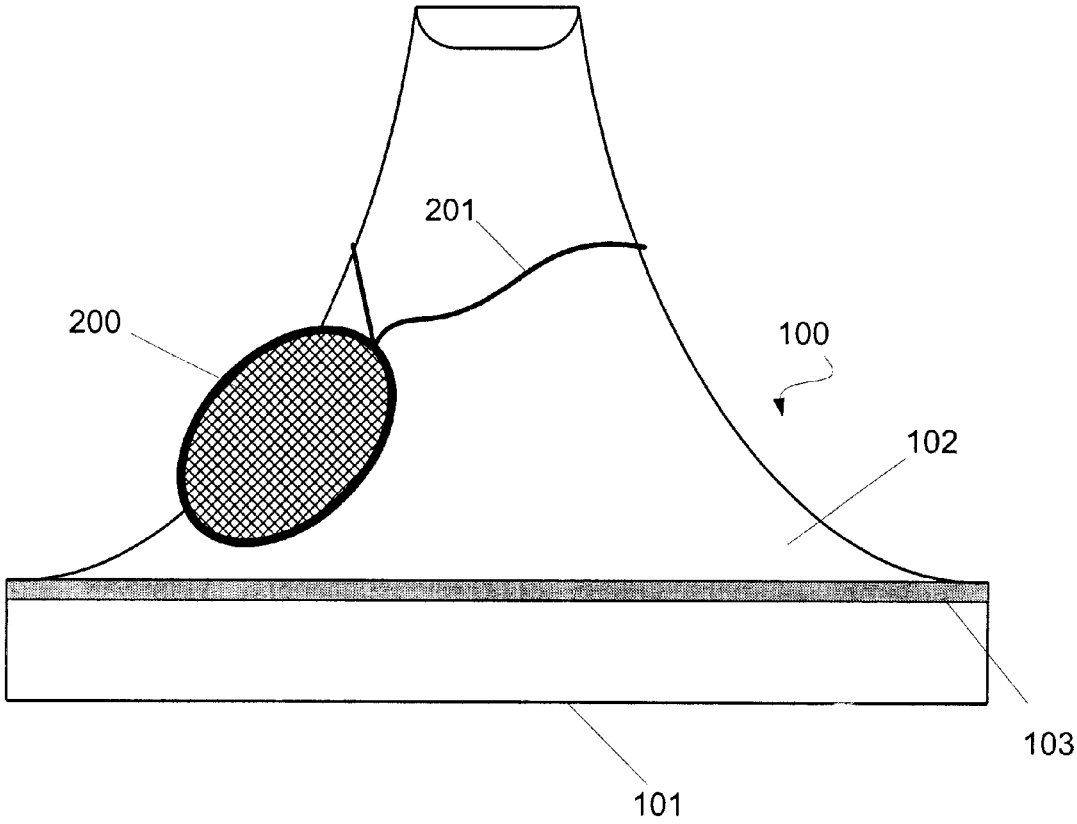
FIG. 4 is an illustration of a heat pack of the present invention as applied to a cathode ray tube.

FIG. 4 illustrates a heated heat pack (200) of the present invention as applied to a cathode ray tube (100) to heat or maintain the temperature of the cathode ray tube (100). As shown in FIG. 4, the cathode ray tube (100) may be disposed with its neck portion (102) pointed upward. The cord (201) of the heat pack (200) can then be placed around the neck (102) so as to hold the heat pack (200) on the anode or funnel portion (102) of the cathode ray tube (100).

In this embodiment, the length of the cord (201) is determined by the size of the neck (102) of the cathode ray tube (100) and the proper position of the heat pack (200) on the anode (102) of the tube (100). Additionally, as the pack (200) hangs from the neck (102) of the tube (100), if the pack (200) is constructed as illustrated and described in FIG. 2, i.e., a flexible bag (202) enclosing a heat-conducting material (203), the pack (200) will naturally deform against the neck (102) of the cathode ray tube (100) to maximize the surface area in contact with the neck (102) and, hence, the transfer of heat.

Figure 5:
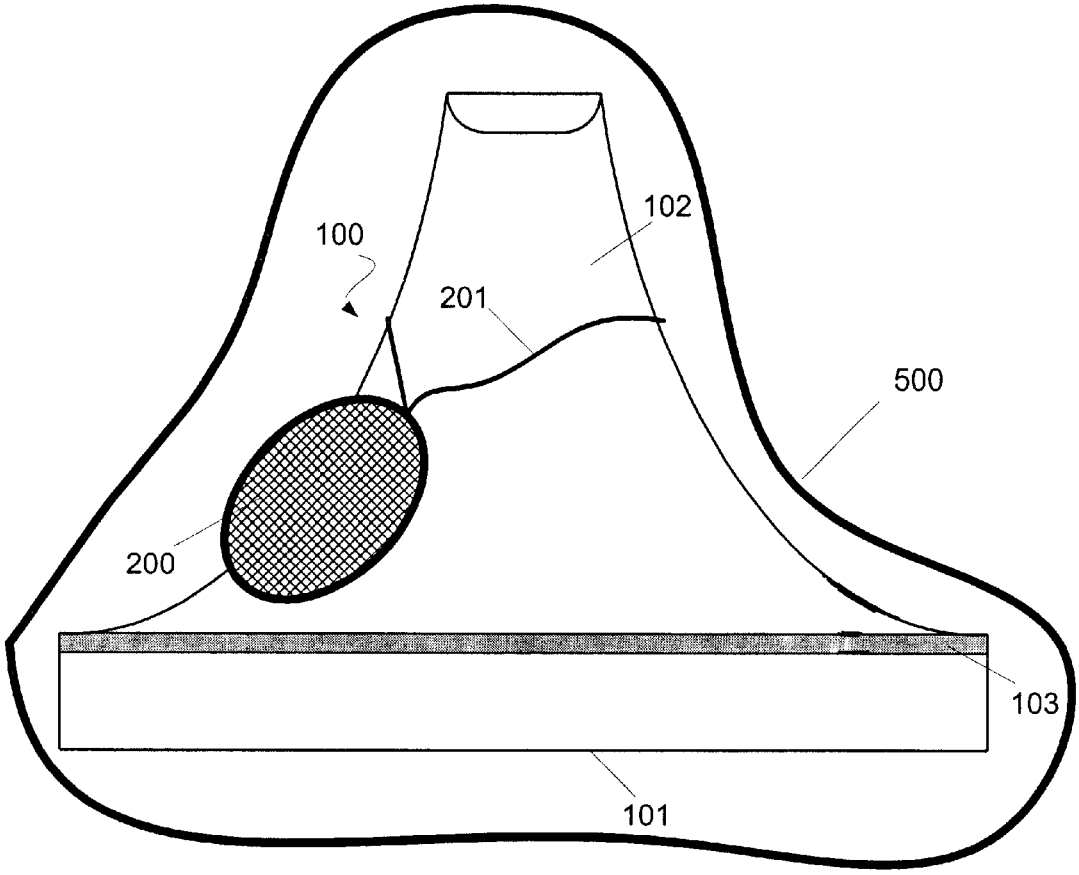
FIG. 5 illustrates the use of a heat pack of the present invention with an insulating envelope.

FIG. 5 illustrates the same embodiment of the present invention as illustrated in FIG. 4, with one addition. As shown in FIG. 5, an insulating envelope or blanket (500) may be placed around the cathode ray tube (100) in order to assist in heating or maintaining the temperature of the cathode ray tube (100). The insulating envelope or blanket (500) can be made of any thermal insulating material. Additionally, the insulating envelope or blanket (500) may have a reflective layer disposed around its interior to reflect heat back into the area around the cathode ray tube (100).

The insulating envelope or blanket (500) can be used before the heating pack (200) is applied to maintain the temperature of the cathode ray tube (100). If the tube (100) is not waiting long before being input the frit knocking station, or if the insulating envelope or blanket (500) does a sufficient job maintaining the temperature of the tube (100), the heating pack (200) may not be necessary.

Figure 6:
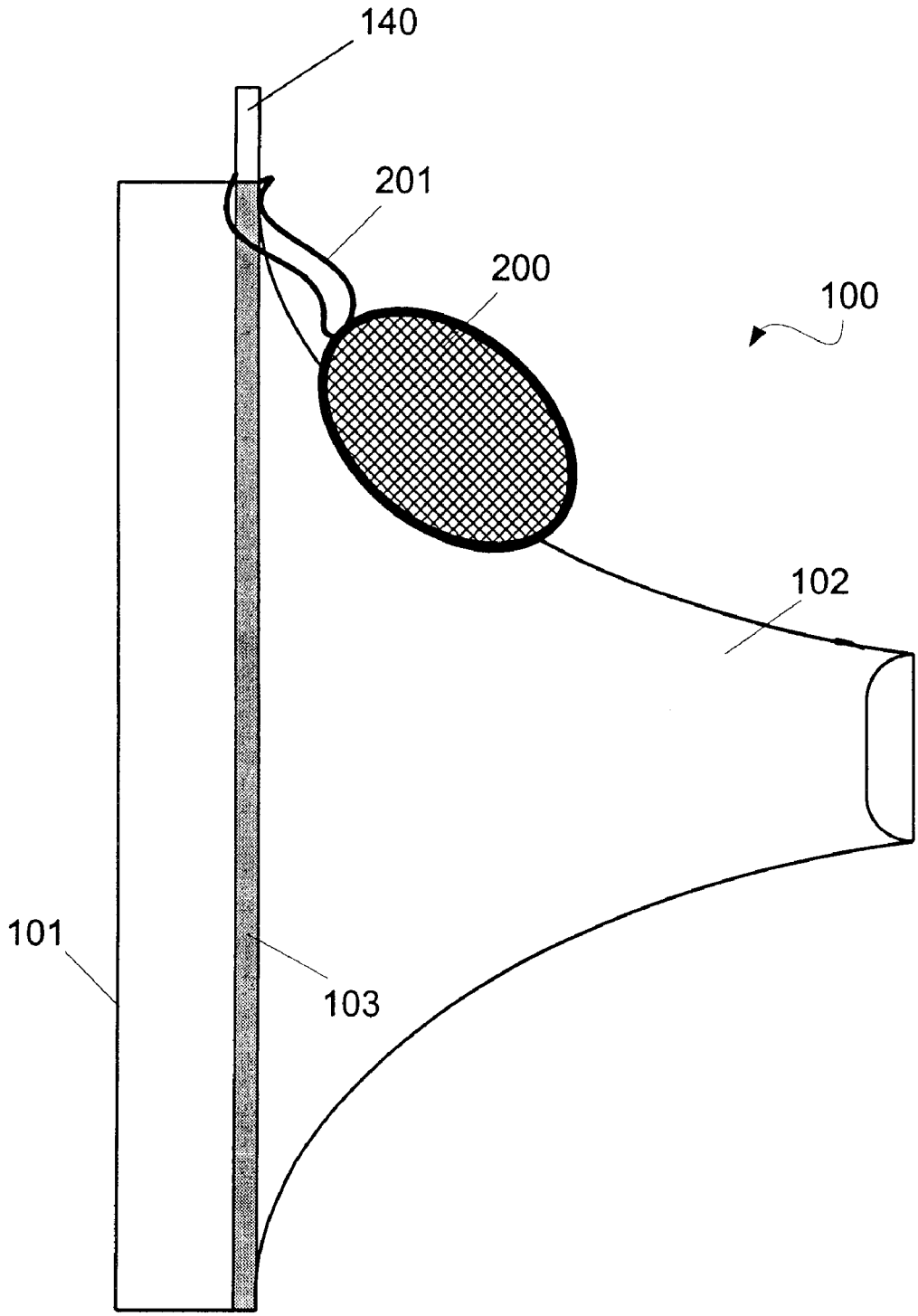
FIG. 6 illustrates a second method of applying a heat pack of the present invention to a cathode ray tube.

FIG. 6 illustrates another embodiment of the present invention. As shown in FIG. 6, the cathode ray tube (100) may be oriented with the neck (102) pointed laterally while waiting to undergo a frit knocking procedure. Consequently, the cord (201) on the heating pack (200) can be hung around an extension (140).

Again, in this embodiment, the length of the cord (201) is determined by the size of the relative distance between the extension (140) and the neck (102) of the cathode ray tube (100), and the proper position of the heat pack (200) on the anode (102) of the tube (100). Additionally, as the pack (200) hangs from the extension (140) of the tube (100), if the pack (200) is constructed as illustrated and described in FIG. 2, i.e., a flexible bag (202) enclosing a heat-conducting material (203), the pack (200) will naturally deform against the neck (102) of the cathode ray tube (100) to maximize the surface area in contact with the neck (102) and, hence, the transfer of heat.

Figure 7:
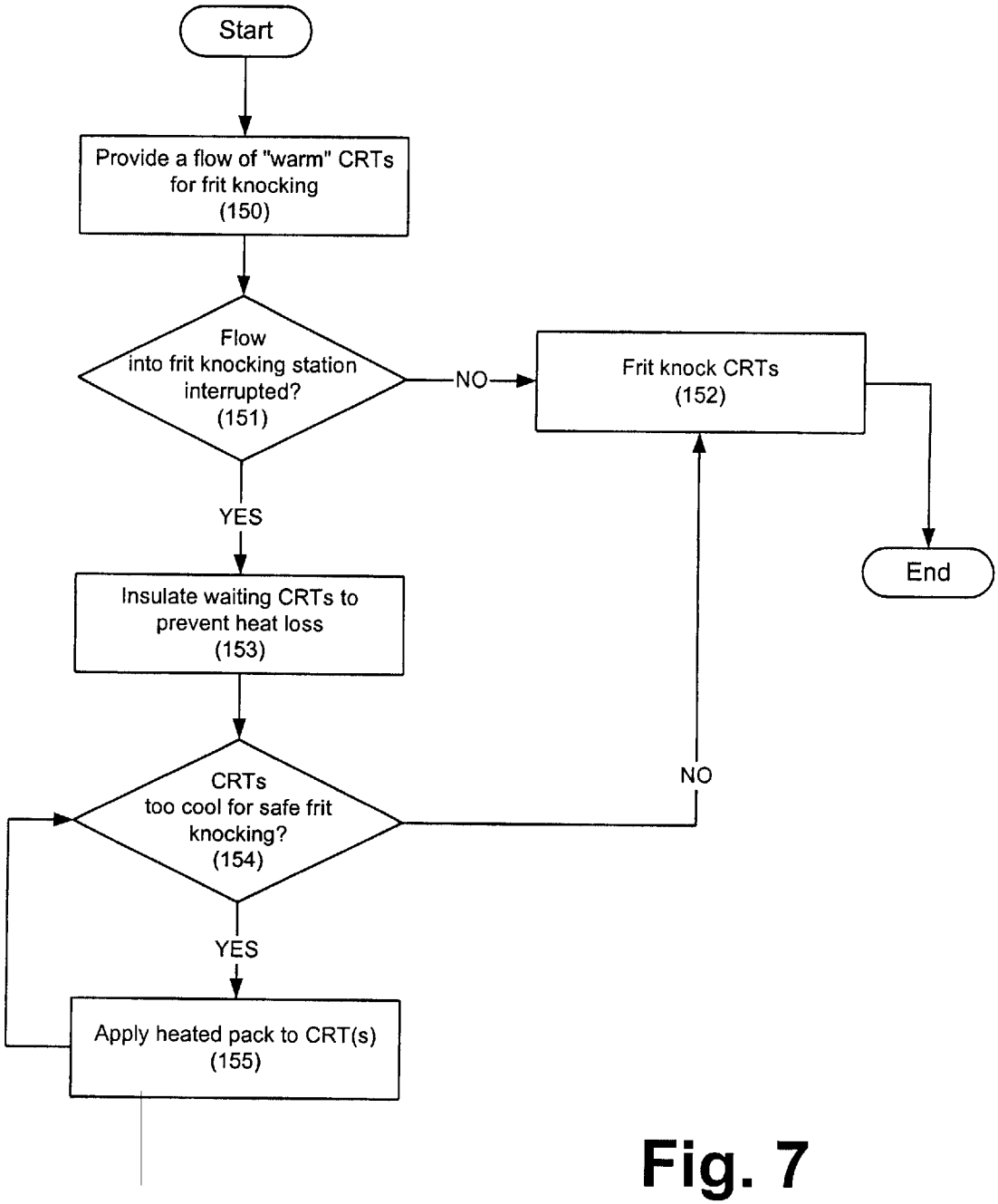
FIG. 7 is a flowchart illustrating a preferred method of the present invention.

The present invention encompasses the methods of making and using the heating pack and related systems described above. FIG. 7 is a flowchart illustrating a preferred embodiment of the method of the present invention.

As shown in FIG. 7, the method begins as a flow of warm cathode ray tubes are provided to a frit knocking station (150). This flow into the frit knocking station may be interrupted for a variety of reasons (151). If the flow is not interrupted and the frit knocking station keeps up with the flow of available cathode ray tubes, the frit of each tube will be evaluated according to normal procedures (152).

However, the flow may be interrupted or, for some reason, one or more cathode ray tubes must be pulled from the production line. In either case, one or more warm cathode ray tubes may be waiting to enter the frit knocking station and undergo frit knocking. As described above, allowing these tubes to cool or introducing them to the frit knocking station cold increases the risk of dangerous and damaging external arcing during the evaluation.

The measures taken at this point may depend on how long the tube can expect to wait before being taken up for frit knocking. If the wait will be short, the cathode ray tube or tubes may be insulated to prevent heat loss (153). This measure may be sufficient if the wait is, in deed, not too long. If the frit knocking station is ready for the cathode ray tube, and the temperature of tube is still sufficiently high to avoid external arcing (154), the tube may be input to the frit knocking station (152).

Alternatively, if the tube has cooled below the acceptable temperature for arc-free frit knocking (154), a heat pack or packs are applied to the tube in any of the ways described above to raise the temperature of the tube (155). When the temperature has been sufficiently elevated, the tube can be input to the frit knocking station (152).

If the tube (155) is expected to wait a long time before being frit knocked, e.g., overnight, the insulation step (153) may be skipped. The tube is then allowed to cool and is heated, for example, as in step (154) when needed by the frit knocking station.

Additionally, a heat pack or packs may be applied with the insulation in step (153). This may be done if the wait is expected to be long enough to allow the insulated tube to cool and the delay in reheating the tube is to be avoided. Consequently, by adding a heat pack to the insulated tube, the tube will stay at an acceptably high temperature longer and be ready for immediate input to the frit knocking station.

In the embodiments illustrated above, a single heating pack (200) is shown for heating the cathode ray tube (100). However, two or more heating packs (200) can be applied simultaneously to more quickly raise the temperature of the cathode ray tube (100).

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A system for heating or maintaining a temperature of a cathode ray tube waiting to undergo a frit knocking process, said system comprising:

a heat pack for transferring heat to said cathode ray tube; and an oven for heating said heat pack.

2. The system of claim 1, wherein said heat pack further comprises a cord by which said heat pack can be suspended on, and in thermal contact with, said cathode ray tube.

3. The system of claim 1, wherein said heat pack comprises:

a flexible bag; and a heat retaining and transmitting material disposed in said bag.

4. The system of claim 1, wherein said oven comprises a control system.

5. The system of claim 4, wherein said control system comprises a thermostat.

6. The system of claim 4, wherein said control system comprises a timer.

7. The system of claim 1, further comprising a thermally-insulating envelope sized to receive said cathode ray tube.

8. A method of preventing external arcing during a frit knocking process in a cathode ray tube production line, said method comprising heating a cathode ray tube which is waiting to undergo frit knocking.

9. The method of claim 8, wherein said heating is performed by:

heating a heat pack; and applying said heated heat pack to said cathode ray tube, such that said heat pack transfers heat to said cathode ray tube.

10. The method of claim 9, wherein said applying said heat pack further comprises suspending said heat pack on said cathode ray tube by a cord connected to said heat pack.

11. The method of claim 9, wherein said heat pack comprises a flexible bag; and a deformable heat retaining and transmitting material disposed in said bag, said method further comprising deforming said heat pack to maximize a surface area of said heat pack in contact with said cathode ray tube.

12. The method of claim 8, further comprising thermally-insulating said cathode ray tube.

13. A system for preventing external arcing during a frit knocking process in a cathode ray tube production line, said system comprising:

means for frit knocking a cathode ray tube; and means for heating a cathode ray tube which is waiting to undergo frit knocking.

14. The system of claim 13, wherein said means for heating is a heat pack that is heated and applied to said cathode ray tube such that said heat pack transfers heat to said cathode ray tube.

15. The system of claim 14, further comprising means for suspending said heat pack on and in thermal contact with said cathode ray tube.

16. The system of claim 14, wherein said heat pack comprises:

a flexible bag; and a deformable heat retaining and transmitting material disposed in said bag.

17. The system of claim 13, further comprising means for thermally-insulating said cathode ray tube.

18. A method of preventing external arcing during a frit knocking process in a cathode ray tube production line, said method comprising thermally insulating a cathode ray tube which is waiting to undergo frit knocking, wherein said step of thermally insulating said cathode ray tube is performed by entirely enclosing said cathode ray tube in a thermally-insulating envelope.

19. A system for heating or maintaining a temperature of a cathode ray tube waiting to undergo a frit knocking process, said system comprising:

a thermally-insulating envelope sized to receive, totally enclose, and insulate said cathode ray tube.

20. The system of claim 19, further comprising:

a heat pack for transferring heat to said cathode ray tube; and an oven for heating said heat pack, wherein said heat pack is applied to said cathode ray tube while said cathode ray tube is disposed in said thermally-insulating envelope.

21. A system for heating or maintaining a temperature of a cathode ray tube waiting to undergo a frit knocking process, said system comprising:

at least one heat pack for transferring heat to said cathode ray tube, wherein said heat pack comprises a flexible bag and a heat retaining and transmitting material disposed in said flexible bag.

22. The system of claim 21, wherein said heat pack further comprises a cord by which said heat pack can be suspended on, and in thermal contact with, said cathode ray tube.

23. The system of claim 21, further comprising an oven for heating said heat pack.

24. The system of claim 23, wherein said oven comprises a control system.

25. The system of claim 24, wherein said control system comprises a thermostat.

26. The system of claim 24, wherein said control system comprises a timer.

27. The system of claim 21, further comprising a thermally-insulating envelope sized to receive and enclose said cathode ray tube.

28. A method of preventing external arcing during a frit knocking process in a cathode ray tube production line, said method comprising heating a cathode ray tube which is waiting to undergo frit knocking, wherein said heating is performed by applying a heated heat pack to said cathode ray tube, such that said heat pack transfers heat to said cathode ray tube;

wherein said heat pack comprises a flexible bag and a deformable heat retaining and transmitting material disposed in said flexible bag.

29. The method of claim 28, further comprising deforming said heat pack to maximize a surface area of said heat pack in contact with said cathode ray tube.

30. The method of claim 28, wherein said applying said heat pack further comprises suspending said heat pack on said cathode ray tube by a cord connected to said heat pack.

31. The method of claim 28, further comprising thermally-insulating said cathode ray tube.

* * * * *